US006500327B1

(12) United States Patent
Saitoh et al.

(10) Patent No.: US 6,500,327 B1
(45) Date of Patent: Dec. 31, 2002

(54) SN-BI ALLOY PLATING BATH AND METHOD OF PLATING USING THE SAME

(75) Inventors: Junichi Saitoh, Sabae; Tatsuo Kunishi, Omihachiman; Yukio Hamaji, Otsu, all of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/497,808

(22) Filed: Feb. 3, 2000

(30) Foreign Application Priority Data

Feb. 12, 1999 (JP) ..... 11-034344

(51) Int. Cl.[7] ..... C25D 3/60; C25D 3/56
(52) U.S. Cl. ..... 205/252; 205/238
(58) Field of Search ..... 205/238, 252, 205/253, 254

(56) References Cited

U.S. PATENT DOCUMENTS

| | | | | |
|---|---|---|---|---|
| 3,360,446 A | | 12/1967 | Jongkind et al. | |
| 4,162,205 A | | 7/1979 | Wilson et al. | |
| 5,039,576 A | | 8/1991 | Wilson | |
| 5,674,374 A | * | 10/1997 | Sakurai et al. | 205/252 |

FOREIGN PATENT DOCUMENTS

| | | | | |
|---|---|---|---|---|
| EP | 0715003 A1 | | 6/1996 | |
| EP | 0770711 A1 | | 5/1997 | |
| EP | 0829557 A1 | | 3/1998 | |
| FR | 1128580 | | 1/1957 | |
| JP | 3-243788 | | 10/1991 | |
| JP | 6-340994 | * | 12/1994 | C25D/03/56 |
| JP | 7-138782 | * | 5/1995 | C25D/03/56 |
| JP | 11-200088 | | 7/1999 | |

OTHER PUBLICATIONS

WPI Accession No. 99–244904 & CN 1204701 A (WAN) see abstract.
WPI Accession No. 98–059605 & JP 9302498 A (DAIWA) see abstract.
WPI Accession No. 96–182030 & JP 8027590 A (OKUNO) see abstract.
WPI Accession No. 99–229108 & JP 7138782 A (DIPSOL) see abstract.
WPI Accession No. 91–364687 & JP 3243788 A (DAIWA) see abstract.
WPI Accession No. 77–33285Y & JP 50101235 A (NIHON) see abstract.
Japanese Examination Report dated Dec. 18, 2001, along with an English translation

* cited by examiner

*Primary Examiner*—Margaret G. Moore
*Assistant Examiner*—Michael J Feely
(74) *Attorney, Agent, or Firm*—Ostrolenk, Faber, Gerb & Soffen, LLP

(57) ABSTRACT

An Sn—Bi alloy plating bath has a pH about 2.0 to 9.0 and comprises $Bi^{3+}$ ions, $Sn^{2+}$ ions, complexing agent (I) and complexing agent (II). Complexing agent (I) can be (a) aliphatic dicarboxylic acids having alkyl groups of 1–3 carbon atoms, (b) aliphatic hydroxymonocarboxylic acids having alkyl groups of 1–3 carbon atoms, (c) aliphatic hydroxypolycarboxylic acids having alkyl groups of 1–4 carbon atoms, (d) monosaccharides, polyhydroxycarboxylic acids produced by partially oxidizing the monosaccharides, and their cyclic ester compounds, and (e) condensed phosphoric acids. Complexing Agent (II) can be (s) ethylenediamineteraacetic acid (EDTA), (t) nitrilotriacetic acid (NTA), and (u) trans-1,2-cyclohexanediaminetetraacetic acid (CyDTA).

18 Claims, No Drawings

SN-BI ALLOY PLATING BATH AND METHOD OF PLATING USING THE SAME

BACKGROUND OF THE INVENTION

1. Field of the Invention

The present invention relates to an Sn—Bi alloy plating bath, and more particularly to an Sn-Bi alloy plating bath which does not erode a piece to be plated, and has a high stability.

2. Description of the Related Art

In the electronic industrial field, Sn—Pb alloy platings have been widely used for soldering electrodes. In recent years, there have been anxieties about the influence of the Pb contained in the Sn—Pb alloy platings which may be exerted over the environment. Sn alloy platings which to not contain Pb have been demanded. Therefore, greater attention has been paid to Sn—Bi alloy platings, which have a low melting point and excellent soldering properties.

Many of Sn—Bi alloy plating baths have a strong acidity, namely, pH 1.0 or lower, in order to dissolve large amounts of bismuth. Since a large part of the electronic components pieces to be plated are composites containing ceramics, glass, ferrite, and so forth, there has been the problem that the electronic components become eroded by such high strong acidic baths, causing the deterioration of their characteristics.

For the purpose of improving the problem of the eroding properties, Japanese Unexamined Patent Publication No. 6-340994 and Japanese Unexamined Patent Publication No. 7-138782 disclose Sn—Bi alloy plating baths containing various complexing agents and having a pH of 2.0–9.0. Bismuth ions and tin ions are stabilized in the baths by addition of the complexing agents. As a result, plating baths within the range of from weak acidity to neutral are realized. However, these plating baths have problems of stability, and should be improved further to be used industrially.

SUMMARY OF THE INVENTION

The present invention is directed to a Sn—Bi alloy plating bath which is stable enough to use continuously in the electronic industrial field and a method of plating using the Sn—Bi alloy plating bath. The Sn—Bi alloy plating bath has a pH of about 2.0 to 9.0 and comprises $Bi^{3+}$ ions, $Sn^{2+}$ ions, a complexing agent (I) and a complexing agent (II).

The complexing agent (I) is selected from the group consisting of (a) aliphatic dicarboxylic acids having alkyl groups of 1–3 carbon atoms, (b) aliphatic hydroxymonocarboxylic acids having alkyl groups of 1–3 carbon atoms, (c) aliphatic hydroxypolycarboxylic acids having alkyl groups of 1–4 carbon atoms, (d) monosaccharides, polyhydroxycarboxylic acids produced by partially oxidizing the monosaccharides, and their cyclic ester compounds, and (e) condensed phosphoric acids.

The complexing agent (II) is selected from the group consisting of (s) ethylenediaminetetraacetic acid (EDTA), (t) nitrilotriacetic acid (NTA), and (u) trans-1,2-cyclohexanediaminetetraacetic acid (CyDTA).

The Sn—Bi alloy plating bath has a pH of about 2.0 to 9.0 and comprises $Bi^{3+}$ ions, $Sn^{2+}$ ions, complexing agent (I) and complexing agent (II).

Preferably, the concentration ratio of complexing agent (II) in mol/l to the $Bi^{3+}$ ions in mol/l is at least about 10, the concentration ratio of complexing agent (II) in mol/l to the $Sn^{2+}$ ions in mol/l is at least about 1, and the concentration ratio of complexing agent (I) in mol/l to the $Sn^{2+}$ ions in mol/l is at least about 0.1.

According to the present invention, electronic components pieces made of ceramics, glass, ferrite or the like, can be plated at a high cathode current density without eroding the electronic components. The plating bath of the present invention has a high bath stability and can be used for a long time without the bath decomposition occurring.

DETAILED DESCRIPTION OF PREFERRED EMBODIMENTS

As a result of the intensive examination by the inventors of the present invention, it has been found that the stability of a bath in the weak acidic range can be remarkably enhanced by adding to the bath a complexing agent (I) selected from the below-described (a) through (e) and a complexing agent (II) selected from the aminocarboxlic acids of the below-described (s) through (u) as complexing agents for the plating bath. The practical application of the Sn—Bi alloy plating bath enables avoidance of eroding electronic component pieces to be plated made of ceramics, glass, ferrite or the like, and it can be used at a relatively high cathode current density and has an excellent bath-stability.

For complexing agent (I), (a) aliphatic dicarboxylic acids having alkyl groups of 1–3 carbon atoms, (b) aliphatic hydroxymonocarboxylic acids having alkyl groups of 1–3 carbon atoms, (c) aliphatic hydroxypolycarboxylic acids having alkyl groups of 1–4 carbon atoms, (d) monosaccharides, polyhydroxycarboxylic acids produced by partially oxidizing the monosaccharides, and their cyclic ester compounds, and (e) condensed phosphoric acids can be employed.

For complexing agent (II), (s) ethylenediaminetetraacetic acid (EDTA), (t) nitrilotriacetic acid (NTA), and (u) trans-1,2-cyclohexanediaminetetraacetic acid (CyDTA) can be used.

Preferable examples of (a)–(e) as the complexing agent (I) are described below. As the aliphatic dicarboxylic acids (a) having alkyl groups of 1–3 carbon atoms, malonic acid, succinic acid or the like; as the aliphatic hydroxymonocarboxylic acids (b) having alkyl groups of 1–3 carbon atoms, glycolic acid, lactic acid or the like; as the aliphatic hydroxypolycarboxylic acids (c) having alkyl groups 1–4 carbon atoms, citric acid, tartaric acid, malic acid or the like; as the monosaccharides, the polyhydroxycarboxylic acids produced by partially oxidizing the monosaccharide, and their cyclic ester compounds (d), gluconic acid, glcoheptic acid, δ-gluconic lactone, or the like; and as the condensed phosphoric acids (e), pyrophosphoric acid, tripolyphosphoric acid or the like, are exemplified.

In the present plating bath, preferably, the concentration ratio of complexing agent (II) (mol/l)/$Bi^{3+}$ (mol/l) is at least about 10, the concentration ratio of complexing agent (II) (mol/l)/$Sn^{2+}$ (mol/l) is at least about 1, and the concentration ratio of complexing agent (I) (mol/l)/$Sn^{2+}$(mol/l) is at least about 0.1. With the above-described concentration ratios, a plating bath which has a high bath stability and which can be used at a high current density can be realized.

The standard electrode potential ($Bi^{3+}/Bi$ $E^0$=+0.215 V) based on the standard hydrogen electrode with respect of the oxidation of Bi, is nobler than the standard electrode potential ($Sn^{4+}/Sn^{2+}E^0$=0.154 V) based on the standard hydrogen electrode at which $Sn^{2+}$ is oxidized to $Sn^{4+}$. Therefore, in a Sn—Bi alloy plating bath, $Bi^{3+}$ is reduced with $Sn^{2+}$ so that the decomposition of the bath, such as the deposition of Bi, readily occurs. Accordingly, it is important for the purpose of stabilizing the bath to select the kinds and ratios of complex ions to be in the bath. The order of magnitude of the complex stability constants between Sn and Bi with the complexing agent (I) and the complexing agent (II) used in this invention is complexing agent (II)—Bi> complexing agent (II)—Sn>> complexing agent(1)—Bi> complexing agent (I)—Sn.

The ratios of the respective complex ions to be produced in the bath are determined by this relationship between the magnitudes of the complex stability constants, and the concentration ratios of the respective metals to the complexing agents. A complex having a higher complex stability constant is formed precedently, and the formed complex has a higher stability.

In the composition of the plating bath of the present invention, substantially the total amount of $Bi^{3+}$ forms a complex with complexing agent (II) precedently. The complexing agent (II) remaining, not coordinated to $Bi^{3+}$, then forms a complex with $Sn^{2+}$. The $Sn^{2+}$ remaining and not forming the complex with complexing agent (II) then produces a complex with the complexing agent (I). Accordingly, three kinds of complexes, namely, the complexes of complexing agent (II) with Bi, complexing agent (II) with Sn, and complexing agent (I) with Sn, are mainly formed. The complex of complexing agent (II)—Bi has a very high stability since the complexing agent (II) has a much higher complexing power as compared with complexing agent (I). Therefore, $Bi^{3+}$ can be prevented from being reduced with $Sn^{2+}$, that is, the decomposition of the bath can be prevented.

If complexing agent (II) only is used in this plating bath, without complexing agent (I), a large part of the complexes of complexing agent (II) with Sn and complexing agent (II) with Bi are deposited as the complex salts, since the solubilities are low. Accordingly, the metal ion concentrations in the bath can not be increased, and thereby, it is difficult to use the bath at a high current density. On the other hand, by using complexing agent (I) together with complexing agent (II) as in the present invention, the solubilities of the complexes of complexing agent (II) with Sn and complexing agent (II) with Bi are enhanced. As a result, the metal ion concentrations in the bath can be increased so that the bath can be used at a high current density.

For the above-described reasons, the preferable concentration ratio of complexing agent (II) (mol/l)/$Bi^{3+}$ (mol/l) is at least about 10, the concentration ratio of complexing agent (II) (mol/l)/$Sn^{2+}$ (mol/l) is at least about 1, and the concentration ratio of complexing agent (I) (mol/l)/$Sn^{2+}$ (mol/l) is at least about 0.1, in the plating bath of the present invention. When the concentration ratio of complexing agent (II) (mol/l)/$Bi^{3+}$ (mol/l) is less than about 10, the required amount of the Bi salt can not be dissolved since the solubility of the Bi salt is low, and moreover, the complex of complexing agent (II)—Bi can not be formed with stability, that is, the stability of the bath can not be attained. Further, when the concentration ratio of complexing agent (II) (mol/l)/$Sn^{2+}$ (mol/l) is less than about 1, the ratio of the complex of complexing agent (I)—Sn having a low stability is increased and the stability of the bath can not be attained. Moreover, when the concentration ratio of complexing agent (I) (mol/l)/$Sn^{2+}$ (mol/l) is less than about 0. 1, the metal ion concentrations in the bath can not be increased since the solubilities of the complexities of complexing agent (II)—Sn and complexing agent (II)—Bi are low. Therefore, it is difficult to use the bath at a high current density. As regards the metal ion concentrations of the plating bath, the concentration of $Sn^{2+}$ is about 0.1–0.5 (mol/l), preferably about 0.2–0.4 (mol/l), and that of $Bi^{3+}$ is about 0.005–0.2 (mol/l), preferably about 0.01–0.1 (mol/l).

The pH of the Sn—Bi alloy plating bath of the present invention is preferably about 2.0–9.0. The reason is that when the pH is less than about 2.0, the acidity is extremely strong so that electronic components made of ceramics, glass, ferrite or the like as pieces to be plated are eroded. When the pH is higher than about 9.0, the stability of the complexes is reduced. Therefore, the stability of the bath is deteriorated and the eroding properties for the electronic components are increased.

As a supply source of $Sn^{2+}$, publicly known ones can be used in this invention. For example, tin sulfate, tin chloride, tin sulfamate, tin methansulfonate, tin oxide, tin hydroxide or the like, alone or in mixtures, may be used. As a supply source of $Bi^{3+}$, publicly known ones may be used. For example, bismuth sulfate, bismuth chloride, bismuth sulfamate, bismuth methansulfonate, bismuth oxide, bismuth hydroxide or the like may be added solely or mixed appropriately. For the complexing agent (I) ion and the complexing agent (II) ion, their publicly known supply sources can be used, respectively. Acids, alkali metal salts ammonium salts, divalent tin salts, trivalent bismuth salts, or the like, may be added solely or mixed appropriately. When a divalent tin salt and a trivalent bismuth salt are supplied with complexing agent (I) ion and/or complexing agent (II) ion, $Sn^{2+}$ and $Bi^{3+}$ which are the pair ions for complexing agent (I) ion and complexing agent (II) ions, respectively, constitute a part of the concentrations of $Sn^{2+}$ and $Bi^{3+}$, respectively, and are included with respect to the above-described amount of the metal ions.

Further, a conductive salt may be added to the plating bath of the present invention to improve the conductivity of the plating bath. As the conductive salt, publicly known salts may be used. For example, potassium chloride, ammonium chloride, ammonium sulfate or the like may be added solely or as a mixture. Further, a pH buffer may be added to the plating bath of the present invention to reduce the variation of the pH of the bath. As the pH buffer, publicly known ones may be used. For example, the alkali metal salts, the ammonium salts or the like of boric acid and phosphoric acid may be added solely or appropriately mixed. A brightener may be added to the plating bath of the present invention in addition to the above-described components. As the brightener, nonionic surfactants such as polyoxyethylenealkylamines, alkylnaphthols or the like, amphoteric surfactants such as lauryldimethylaminoacetic acid betaine, imidazolinium betaine or the like, and cationic surfactants such as dodecyltrimethylammonium salt, hexadodecylpyridinium salt, or the like, and anionic surfactants such as polyoxyethylene alkylether sulfates, alkylbenzenesulfonates or the like may be used. In order to prevent the oxidation of $Sn^{2+}$, an anti-oxidant may be added. As the anti-oxidant, publicly known ones may be used. For example, hydroquinone, ascorbic acid, catechol, resorcin or the like may be added.

The Sn—Bi alloy plating bath of the present invention can be advantageously applied when electronic components such as chip capacitors, chip resistors, chip coils or the like are plated. As the anode, for example, Sn metal, Bi metal, Sn—Bi alloys, titanium or carbon plated with platinum, or the like may be used. The bath temperature is about 10–50° C., preferably about 25–30° C. The cathode current density is about 0.1–3.0 A/dm$^2$.

EXAMPLES

Examples 1 Through 8

A copper plate was degreased and pickled. Thereafter, plating was carried out under the conditions as shown in TABLE 1 to form plating films with a thickness of about 5 $\mu$m. Metal compounds used to condition the plating bath were tin methansulfonate and bismuth methansulfonate. As a brightener, an adduct of 2 mols of ethyleneoxide and dodecylamine was used.

In order to evaluate the stability of the plating bath, the plating bath was allowed to stand at room temperature for 30 days after the bath was formed. Then, the turbidity of the bath and the formation of a precipitate were observed. For the analysis of the alloy composition of a plating film, the film was dissolved in an acid and then analyzed by ICP emission spectroscopic analysis. As to soldering properties, the zero cross time was measured at a solder temperature of 230° C. by the meniscograph method using a rosin type flux. As to the eroding properties, a composite component comprising a dielectric ceramic and an Ag electrode as the piece to be plated was plated in a similar manner to that for the copper plate. After the plating, the ceramic surface was observed through a microscope. TABLE 1 shows the results.

TABLE 1

| | Example | | | | | | | |
|---|---|---|---|---|---|---|---|---|
| Component | 1 | 2 | 3 | 4 | 5 | 6 | 7 | 8 |
| $Sn^{2+}$ (mol/l) | 0.2 | 0.2 | 0.4 | 0.4 | 0.4 | 0.4 | 0.2 | 0.2 |
| $Bi^{3+}$ (mol/l) | 0.04 | 0.04 | 0.02 | 0.02 | 0.04 | 0.04 | 0.04 | 0.04 |
| Complexing agent (II) (mol/l) | 0.4 | 0.4 | 0.4 | 0.4 | 0.4 | 0.4 | 0.4 | 0.4 |
| Complexing agent (I) (mol/l) | 0.8 | 0.8 | 0.4 | 0.4 | 0.2 | 0.2 | 0.4 | 0.4 |
| Brightener(g/l) | 1 | 1 | 1 | 1 | 1 | 1 | 1 | 1 |
| pH | 4 | 4 | 4 | 4 | 5 | 5 | 6 | 6 |
| Complexing agent (II) (mol/l)/$Bi^{3+}$ (mol/l) | 10 | 10 | 20 | 20 | 10 | 10 | 10 | 10 |
| Complexing agent (II) (mol/l)/$Sn^{2+}$ (mol/l) | 2 | 2 | 1 | 1 | 1 | 1 | 2 | 2 |
| Complexing agent (I) (mol/l)/$Sn^{2+}$ (mol/l) | 4 | 4 | 1 | 1 | 0.5 | 0.5 | 2 | 2 |
| Bath stability | stable | stable | stable | stable | stable | stable | stable | stable |
| Cathode current density (A/dm$^2$) | 0.5 | 3.0 | 0.5 | 3.0 | 0.5 | 3.0 | 0.5 | 3.0 |
| Bath temperature (° C.) | 25 | 25 | 25 | 25 | 25 | 25 | 25 | 25 |
| Bi content (%) | 28.7 | 26.3 | 12.4 | 9.1 | 15.4 | 13.4 | 25.1 | 23.3 |
| Soldering properties (seconds) | 0.6 | 0.6 | 0.7 | 0.7 | 0.6 | 0.6 | 0.6 | 0.6 |
| Erosion | no | no | no | no | no | no | no | no |

In Examples 1 and 2, citric acid was used as complexing agent (I) and EDTA as complexing agent (II). In Examples 3 and 4, gluconic acid (1) was used as complexing agent (I) and CyDTA as complexing agent (II). In Examples 5 and 6, pyrophosphoric acid was used as complexing agent (I) and NTA as complexing agent (II). In Examples 7 and 8, malonic acid was used as complexing agent (I) and EDTA as complexing agent (II).

In the foregoing EXAMPLES, one kind of complexing agent was selected for each of complexing agent (I) and complexing agent (II). However, this is not restrictive. Two or more kinds of complexing agents may be selected for each of complexing agent (I) and complexing agent (II).

Comparative Examples 1 Through 6

Plating baths having the compositions are shown in TABLE 2 were prepared. The stabilities of the plating baths were observed by a similar method to that of the Examples 1 through 8. TABLE 2 shows these results.

TABLE 2

| | Comparative example | | | | | |
|---|---|---|---|---|---|---|
| Component | 1 | 2 | 3 | 4 | 5 | 6 |
| $Sn^{2+}$ (mol/l) | 0.4 | 0.4 | 0.2 | 0.2 | 0.2 | 0.2 |
| $Bi^{3+}$ (mol/l) | 0.02 | 0.02 | 0.04 | 0.04 | 0.04 | 0.04 |
| Complexing agent (II) | 0.2 | 0.2 | 0.2 | 0.2 | 0 | 0.4 |

TABLE 2-continued

| Component | Comparative example 1 | 2 | 3 | 4 | 5 | 6 |
|---|---|---|---|---|---|---|
| (mol/l) | | | | | | |
| Complexing agent (I) (mol/l) | 0.4 | 0.4 | 0.8 | 0.8 | 0.8 | 0 |
| Brightener(g/l) | 1 | 1 | 1 | 1 | 1 | 1 |
| pH | 4 | 5 | 4 | 6 | 4 | 4 |
| Complexing agent(II) (mol/l)/$Bi^{3+}$ (mol/l) | 10 | 10 | 5 | 5 | 0 | 10 |
| Complexing agent (II) (mol/l)/$Sn^{2+}$ (mol/l) | 0.5 | 0.5 | 1 | 1 | 0 | 2 |
| Complexing agent (I) (mol/l)/$Sn^{2+}$ (mol/l) | 1 | 1 | 4 | 4 | 4 | 0 |
| Bath stability | precipitate | precipitate | precipitate | precipitate | precipitate | precipitate |

In Comparative Examples 1 and 2, citric acid was used as the complexing agent (I) and EDTA as the complexing agent (II). In Comparative Examples 3 and 4, gluconic acid was used as the complexing agent (II) and CYDTA as the complexing agent (I). In Comparative Example 5, pyrophosphoric acid was used as the complexing agent (I). In Comparative Example 6, NTA was used as the complexing agent (II).

While preferred embodiments of the invention have been disclosed, various modes of carrying out the principles disclosed herein are contemplated as being within the scope of the following claims. Therefore, it is understood that the scope of the invention is not to be limited except as otherwise set forth in the claims.

What is claimed is:

1. An Sn—Bi alloy electroplating bath having a pH of about 2.0 to 9.0 and comprising:

$Bi^{3+}$ ions;

$Sn^{2+}$ ions;

at least one complexing agent (I) selected from the group consisting of (a) aliphatic dicarboxylic acids having alkyl groups of 1–3 carbon atoms, (b) aliphatic hydroxymonocarboxylic acids having alkyl groups of 1–3 carbon atoms, (c) aliphatic hydroxypolycarboxylic acids having alkyl groups of 1–4 carbon atoms, (d) monosaccharides, partially oxidized monosaccharides, and their cyclic ester compounds, and (e) condensed phosphoric acids; and at least one complexing agent (II) selected from the group consisting of (s) ethylenediamineteraacetic acid (EDTA), (t) nitrilotriacetic acid (NTA) and (u) trans-1,2-cyclohexanediaminetetraacetic acid (CyDTA), wherein the concentration ratio of complexing agent (II) (mol/l)/$Bi^{3+}$ ions (mol/l) is at least about 10, the concentration ratio of complexing agent (II) (mol/l)/$Sn^{2+}$ ions (mol/l) is at least about 1, and the concentration ratio of complexing agent (I) (mol/l)/$Sn^{2+}$ ions (mol/l) is at least about 0.1.

2. An Sn—Bi alloy electroplating bath according to claim 1, wherein the concentration of $Bi^{3+}$ is about 0.005 to 0.2 mol/l and the concentration of $Sn^{2+}$is about 0.1 to 0.5 mol/l.

3. An Sn—Bi alloy electroplating bath according to claim 2, wherein complexing agent (I) is selected from the group consisting of citric acid, malonic acid, gluconic acid and pyrophosphoric acid.

4. An Sn—Bi alloy electroplating bath according to claim 3, wherein the concentration of $Bi^{3+}$ is about 0.01 to 0.1 mol/l and the concentration of $Sn^{2+}$is about 0.2 to 0.4 mol/l.

5. An Sn—Bi alloy electroplating bath according to claim 2, wherein complexing agent (II) is EDTA.

6. An Sn—Bi alloy electroplating bath according to claim 2, wherein complexing agent (II) is NTA.

7. An Sn—Bi alloy electroplating bath according to claim 2, wherein complexing agent (II) is CyDTA.

8. An Sn—Bi alloy electroplating bath according to claim 1, wherein the concentration of $Bi^{3+}$ is about 0.01 to 0.1 mol/l and the concentration of $Sn^{2+}$is about 0.2 to 0.4 mol/l.

9. An Sn—Bi alloy electroplating bath according to claim 1, wherein complexing agent (I) is selected from the group consisting of citric acid, malonic acid, gluconic acid and pyrophosphoric acid.

10. A method comprising electroplating an electronic component with an Sn—Bi alloy in a plating bath wherein the plating bath is the Sn—Bi alloy plating bath according to claim 1.

11. A method comprising electroplating an electronic component with an Sn—Bi alloy in a plating bath wherein the plating bath is the Sn—Bi alloy plating bath according to claim 2.

12. A method comprising electroplating an electronic component with an Sn—Bi alloy in a plating bath wherein the plating bath is the Sn—Bi alloy plating bath according to claim 3.

13. A method comprising electroplating an electronic component with an Sn—Bi alloy in a plating bath wherein the plating bath is the Sn—Bi alloy plating bath according to claim 4.

14. A method comprising electroplating an electronic component with an Sn—Bi alloy in a plating bath wherein the plating bath is the Sn—Bi alloy plating bath according to claim 5.

15. A method comprising electroplating an electronic component with an Sn—Bi alloy in a plating bath wherein the plating bath is the Sn—Bi alloy plating bath according to claim 6.

16. A method comprising electroplating an electronic component with an Sn—Bi alloy in a plating bath wherein the plating bath is the Sn—Bi alloy plating bath according to claim 7.

17. A method comprising electroplating an electronic component with an Sn—Bi alloy in a plating bath wherein the plating bath is the Sn—Bi alloy plating bath according to claim 10.

18. A method comprising electroplating an electronic component with an Sn—Bi alloy in a plating bath wherein the plating bath is the Sn—Bi alloy plating bath according to claim 9.

* * * * *